US006805643B1

(12) United States Patent
Lin

(10) Patent No.: US 6,805,643 B1
(45) Date of Patent: Oct. 19, 2004

(54) COMPOSITE GOLF CLUB HEAD

(75) Inventor: Chon-Chen Lin, Kaohsiung (TW)

(73) Assignee: O-TA Precision Casting Co., Ltd., Pingtung Hsien (TW)

( * ) Notice: Subject to any disclaimer, the term of this patent is extended or adjusted under 35 U.S.C. 154(b) by 0 days.

(21) Appl. No.: 10/643,725

(22) Filed: Aug. 18, 2003

(51) Int. Cl.[7] ..... A63B 53/08

(52) U.S. Cl. ..... 473/345; 473/347; 473/349; 473/305

(58) Field of Search ..... 473/324, 334, 473/338, 347, 313, 305, 345

(56) References Cited

U.S. PATENT DOCUMENTS 5,328,176 A * 7/1994 Lo ..... 473/342
6,010,411 A * 1/2000 Reyes ..... 473/345
6,524,198 B2 * 2/2003 Takeda ..... 473/338
6,623,378 B2 * 9/2003 Beach et al. ..... 473/345

* cited by examiner

*Primary Examiner*—Gregory Vidovich
*Assistant Examiner*—Alvin A. Hunter, Jr.
(74) *Attorney, Agent, or Firm*—Dellett & Walters

(57) ABSTRACT

A composite golf club head includes a strike plate having a neck formed at an end of the strike plate. A rear portion is formed at an upper side of the strike plate and extends backwards. An inner plate, made up of multiple layers of fiber prepreg material, is adhered to an interior surface of the strike plate by a first of two adhesive sheets. A cover, made up of multiple layers of the fiber prepreg material, is adhered to the back of the rear portion by a second of the adhesive sheets. A bottom plate, made up of a metal material, is adhered to bottom portions of the strike plate and the cover by the adhesive sheets to close the head. A seat is formed inside the bottom plate, and a hole is defined through the seat. A balance member is engaged in the hole.

4 Claims, 5 Drawing Sheets

COMPOSITE GOLF CLUB HEAD

BACKGROUND OF THE INVENTION

1. Field of the Invention

The present invention is related to a golf club, and more particular to a golf club head which includes a strike plate made of light-weight alloy with high strength and a cover made of a fiber prepreg material (pre-impregnated material) assembled together.

2. Description of Related Art

Conventional golf club heads generally have two types of structure and manufacturing methods. The first type of golf club head, made up of a metal material, is integrally formed, or is composed of multiple forged members welded together. The other type of golf club head, made up of composite materials, is composed of a molded body including a strike plate, a neck and a bottom plate, and a fiber upper cover assembled on the body.

However, the conventional golf club heads have some shortcomings, such as being time-consuming to manufacture, difficult to balance the gravity center, and having small sweet spots.

Therefore, the invention provides a composite golf club head to mitigate and/or obviate the aforementioned problems.

SUMMARY OF THE INVENTION

The main objective of the present invention is to provide a composite golf club head which has an increased sweet spot area on a strike plate and is easy to manufacture.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
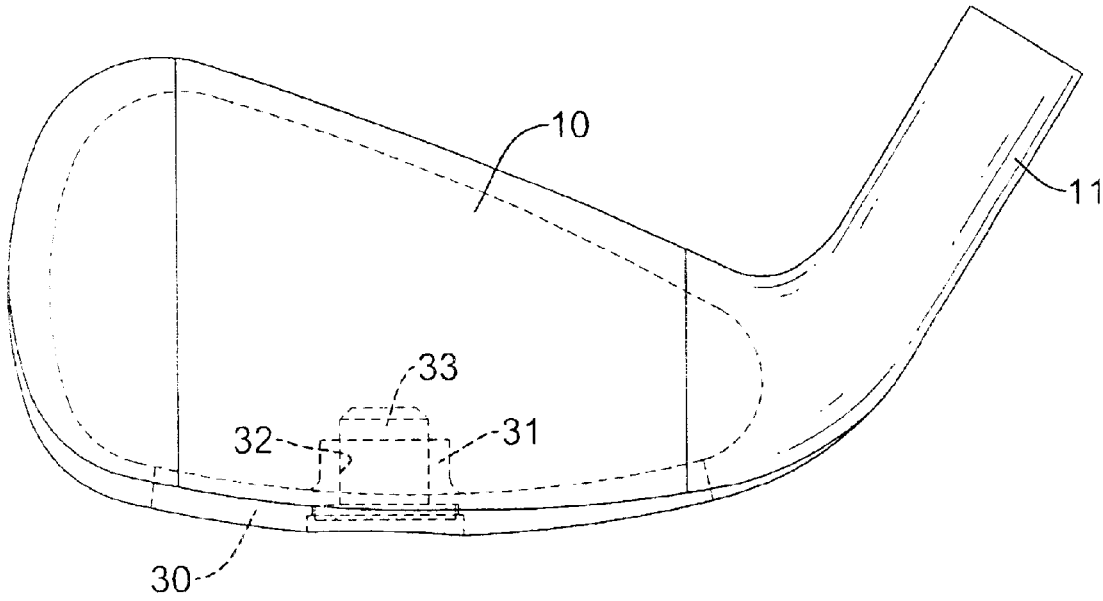
FIG. 1 is a front view of a golf club head in accordance with the invention.
Figure 2:
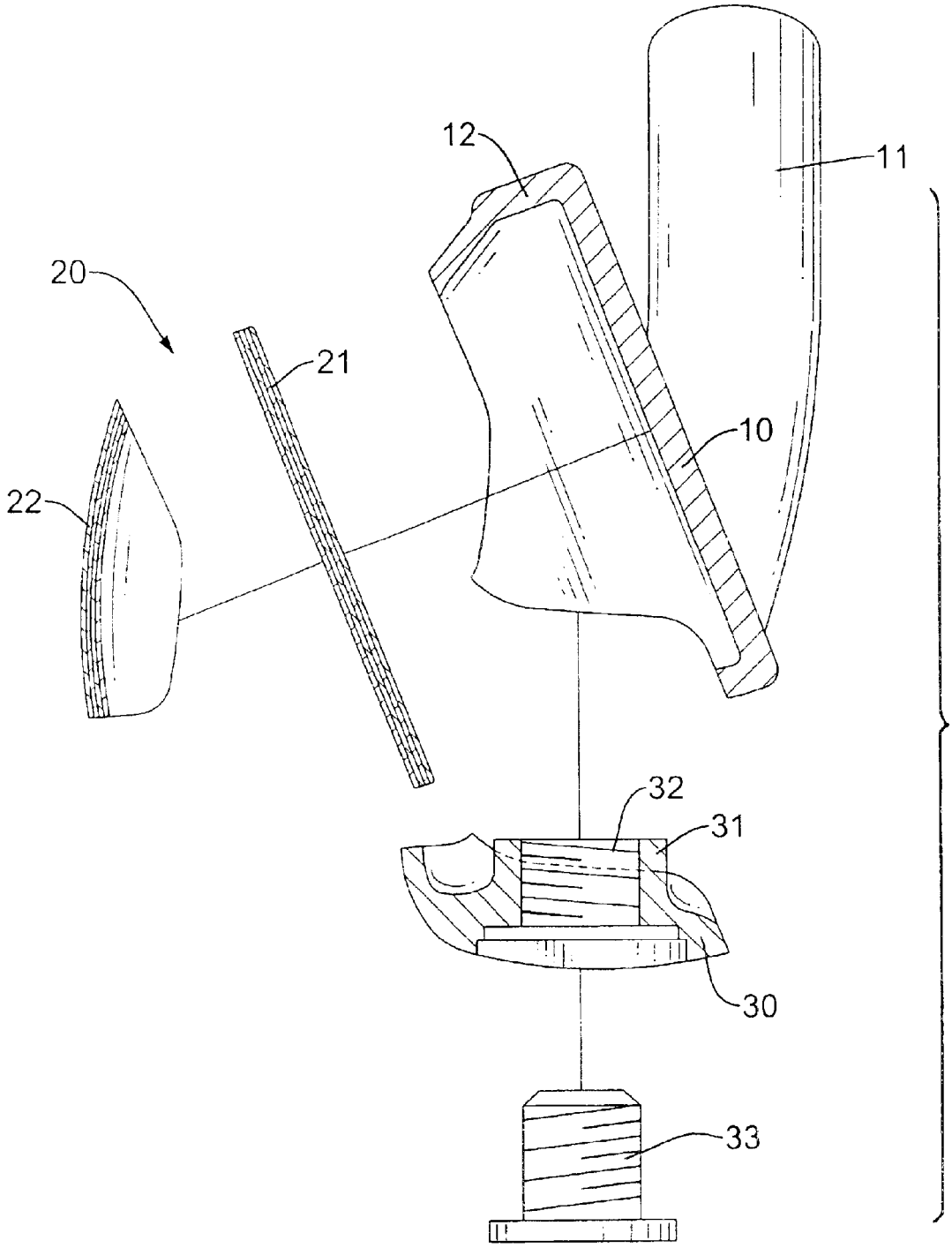
FIG. 2 is an exploded side view of the golf club head in FIG. 1.
Figure 3:
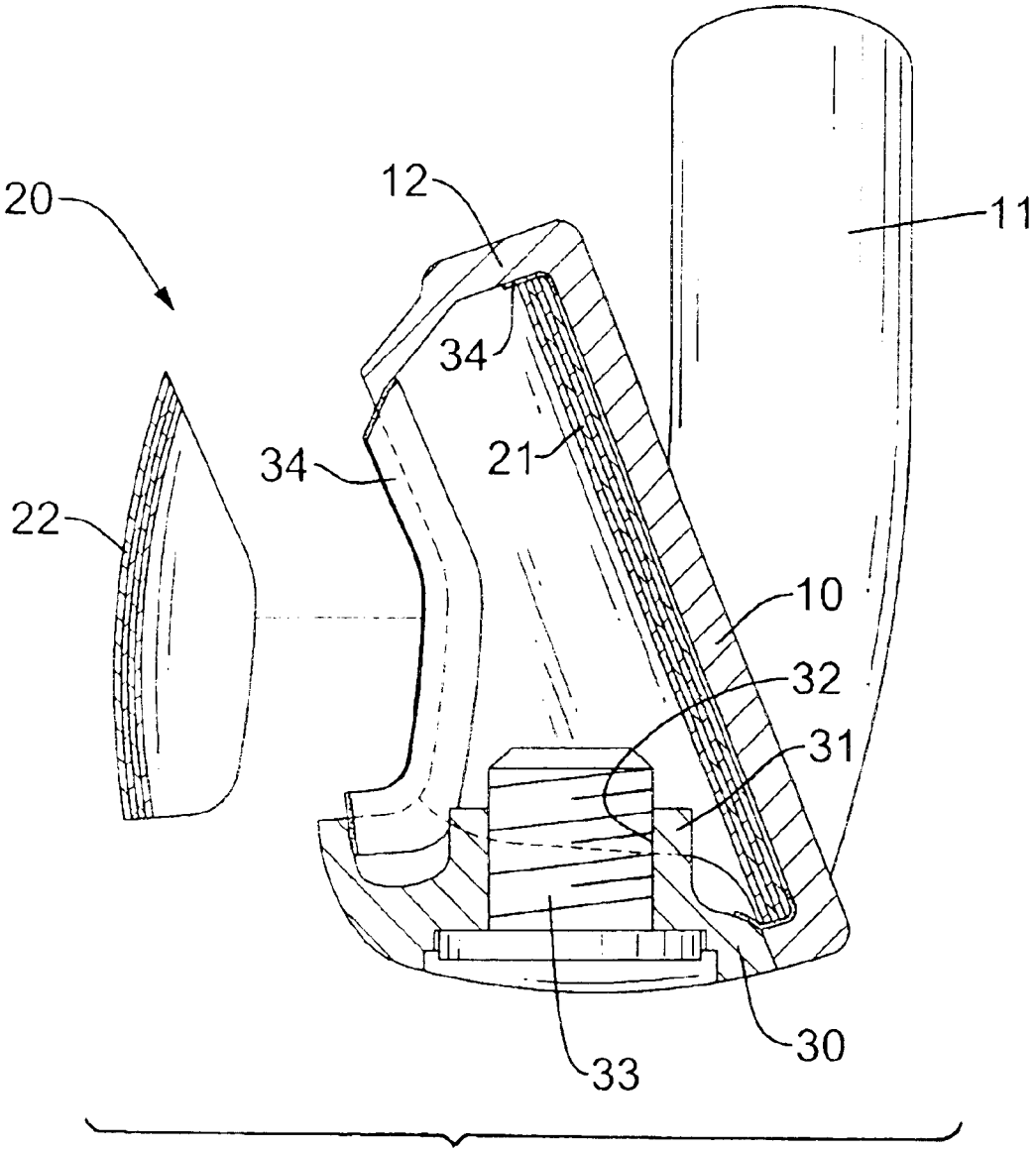
FIG. 3 is a side sectional view of the golf club head in a status that a cover has not been assembled.

Referring to FIGS. 1–3, the golf club head in accordance with the invention has a strike plate (10) and a neck (11) formed at an end of the strike plate (10). A rear portion (12) is formed at an upper side of the strike plate (10) and extends backwards. The strike plate (10) can be integrally formed with the neck (11) and the rear portion (12). Alternatively, the strike plate (10) also can be made as a sandwich structure being composed of a titanium plate, a titanium fiber prepreg material and a carbon fiber prepreg material adhered together, and then the strike plate (10) is embedded between the neck (11) and the rear portion (12).

An inner plate (21), made up of multiple layers of fiber prepreg material, is adhered on an interior surface of the strike plate (10) by a first of two adhesive sheets (34). A cover (22), also made up of multiple layers of fiber prepreg material, is adhered to the back of the rear portion (12) by the second adhesive sheet (34) to form a back housing (20) at the rear side of the strike plate (10). The fiber prepreg material can be carbon fiber, glass fiber, Kevlar™ fiber, boron fiber, titanium fiber, copper fiber, aluminum fiber, etc. impregnated with resin previously.

A bottom plate (30), made up of a metal material, is adhered to a bottom portion of the strike plate (10) and the cover (22) by the adhesive sheets (34) to close the head. A seat (31) is formed inside the bottom plate (30) and a hole (32) is defined through the seat (31).

Figure 4:
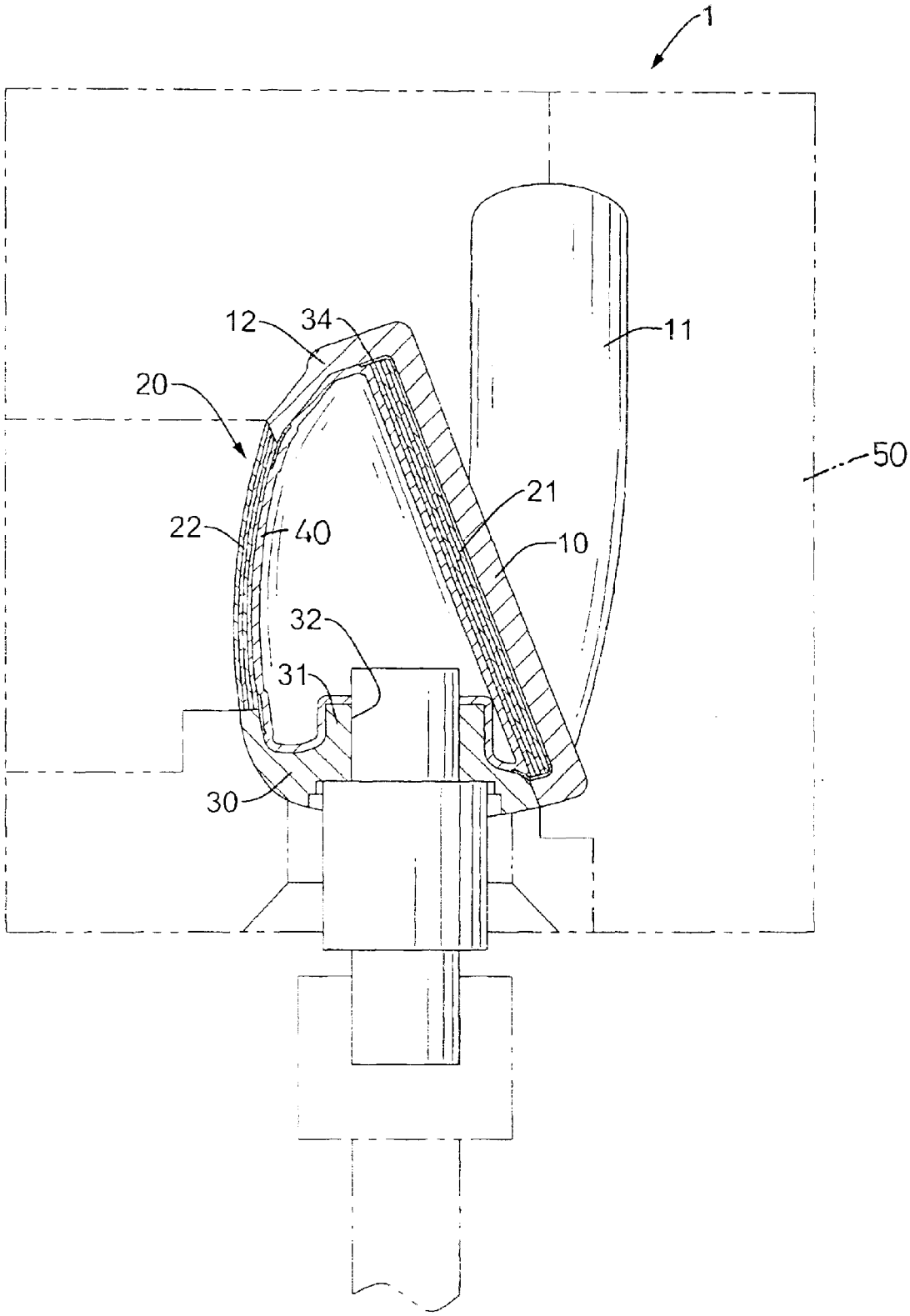
FIG. 4 is a side view sectional of the golf club head in the assembling process.
Figure 5:
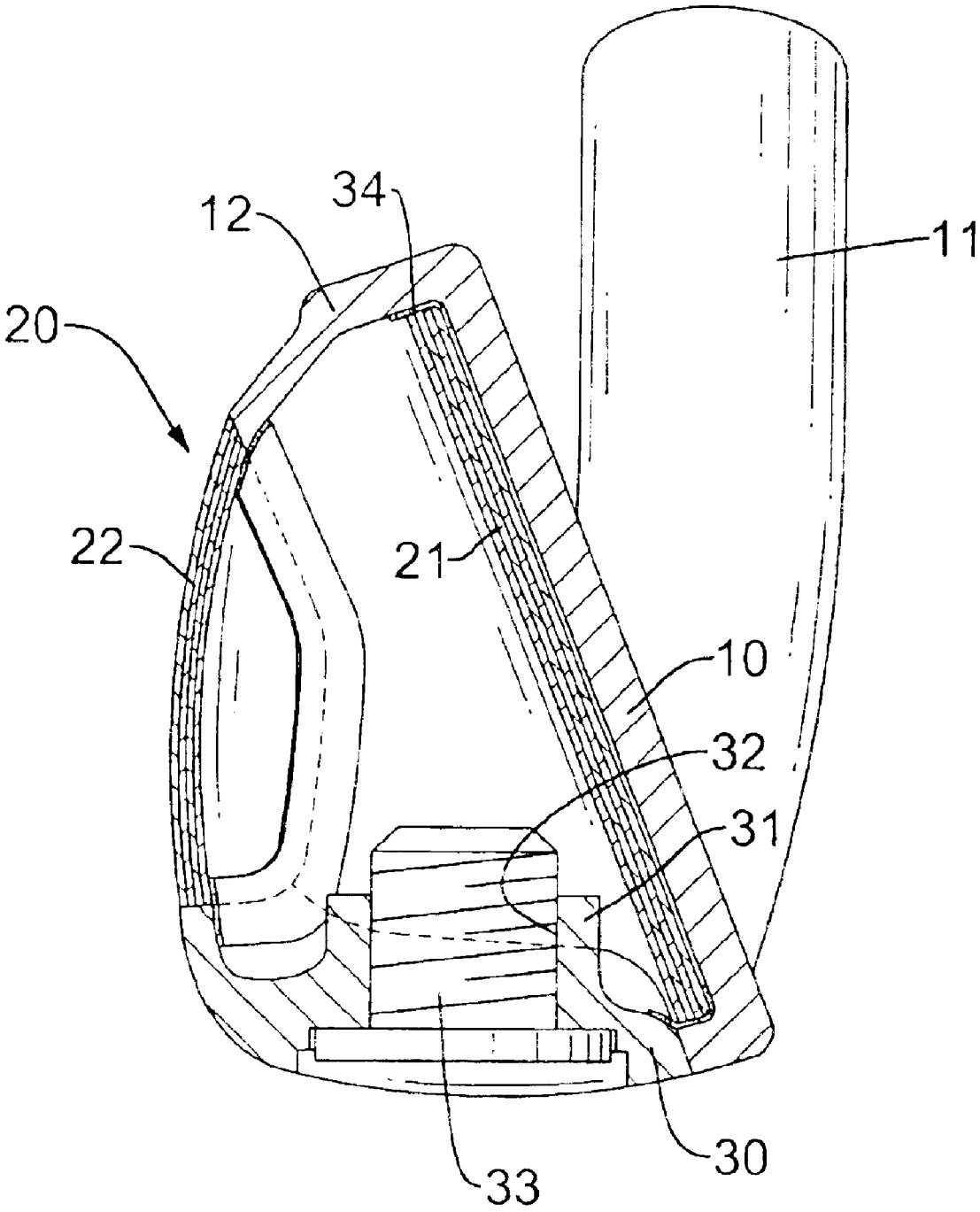
FIG. 5 is a side view sectional of the assembled golf club head.

Referring to FIGS. 4–5, during the manufacturing process, an air cell (40) is received in the golfhead through the hole (32) and has a nozzle (not numbered) provided outside the golf head. Then, the golf head is positioned in a hot-press molding device (50) for heating and pressing the golf head. At the same time, air is pumped into the air cell (40) through the nozzle and the adhesive sheets (34) are pressed to tightly abut the inside wall of the golf head. Thus, there is no gap at joints between the strike plate (10), the back housing (20), and the bottom plate (30).

Afterwards, the air cell (40) is removed through the hole (32) from the golf head, and a balance member (33) can be engaged in the hole (32) to adjust a center of gravity of the golf head.

Therefore, because the strike plate (10) is made up of a light-weight alloy, an area of the strike plate (10) can be increased moderately to enlarge the sweet spot. Furthermore, the fiber prepreg material is easy to be molded and can be securely attached to the interior surface of the strike plate (10). Further still, it is also simple to balance the gravity center, so that it is convenient to manufacture the golf head, and a user can easily handle the golf head.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A composite golf club head comprising:

a strike plate having a neck formed at an end of the strike plate and a rear portion formed at an upper side of the strike plate and extending backwards;

an inner plate, made up of multiple layers of fiber prepreg material, adhered to an interior surface of the strike plate by a first of two adhesive sheets;

a cover, made up of multiple layers of the fiber prepreg material, adhered to the back of the rear portion by a second of the two adhesive sheets;

a bottom plate, made up of a metal material, adhered to bottom portions of the strike plate and the cover by the adhesive sheets to close the head, the bottom plate having a seat formed inside the bottom plate, and a hole defined through the seat; and a balance member engaged in the hole.

2. The composite golf club head as claimed in claim 1, wherein the strike plate is integrally formed with the neck and the rear portion.

3. The composite golf club head as claimed in claim 1, wherein the strike plate is formed as a sandwich structure being composed of a titanium plate, a titanium fiber prepreg material and a carbon fiber prepreg material adhered together, and then embedded between the neck and the rear portion.

4. The composite golf club head as claimed in claim 1, wherein the adhesive sheets tightly abut an inside wall of the golf club head by means of pumping air into an air cell received in the golf head during a manufacturing process.

* * * * *